US006241178B1

(12) United States Patent
Schönmeier et al.

(10) Patent No.: US 6,241,178 B1
(45) Date of Patent: Jun. 5, 2001

(54) WINDER FOR ROLLING SHEETS OF MATERIAL, ESPECIALLY FOR WINDING PAPER OR CARDBOARD SHEETS INTO REELS

(75) Inventors: Herbert Schönmeier; Hans-Friedrich Peters, both of Düsseldorf (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/308,454

(22) PCT Filed: Nov. 5, 1997

(86) PCT No.: PCT/EP97/06111

§ 371 Date: May 19, 1999

§ 102(e) Date: May 19, 1999

(87) PCT Pub. No.: WO98/23515

PCT Pub. Date: Jun. 4, 1998

(30) Foreign Application Priority Data

Nov. 28, 1996 (DE) ..... 196 49 354

(51) Int. Cl.[7] ..... B65H 18/14

(52) U.S. Cl. ..... 242/541.5; 242/530.4; 242/542.2

(58) Field of Search ..... 242/541.5, 541.4, 242/541, 541.6, 541.7, 542, 542.1, 542.2, 542.3, 542.4, 530, 530.4

(56) References Cited

U.S. PATENT DOCUMENTS

| | | | | |
|---|---|---|---|---|
| 4,508,283 | * | 4/1985 | Beisswanger | 242/530 |
| 5,165,618 | * | 11/1992 | Ruff | 242/530.4 |
| 5,190,235 | * | 3/1993 | Schonmeier et al. | 242/542 X |
| 5,335,871 | * | 8/1994 | Fissmann et al. | 242/542 X |
| 5,360,180 | * | 11/1994 | Welp et al. | 242/530.4 |
| 5,405,099 | * | 4/1995 | Hehner et al. | 242/530 |
| 5,464,169 | * | 11/1995 | Henseler et al. | 242/542 |
| 5,553,806 | * | 9/1996 | Lucas | 242/542.4 |
| 5,575,436 | * | 11/1996 | McDermott | 242/542.4 |
| 5,582,361 | * | 12/1996 | Muller et al. | 242/542.4 |
| 5,820,063 | * | 10/1998 | Fissmann et al. | 242/542 X |
| 6,056,230 | * | 5/2000 | Peters et al. | 242/541.5 |

FOREIGN PATENT DOCUMENTS

| | | |
|---|---|---|
| 42 26 840 A1 | 2/1994 | (DE) . |
| 296 15 385 U1 | 1/1997 | (DE) . |
| 0 562 266 A1 | 9/1993 | (EP) . |
| 0 683 125 A2 | 11/1995 | (EP) . |
| WO 95/32908 | 12/1995 | (WO) . |

* cited by examiner

*Primary Examiner*—William A. Rivera
(74) *Attorney, Agent, or Firm*—Herbert Dubno

(57) ABSTRACT

A winding machine for winding rolls of web material in which the rolls are supported by at least one roller beneath them and at least one support roller can be brought into engagement from the roll from beneath and is provided on its surface with a compressible layer of porous synthetic material.

16 Claims, 5 Drawing Sheets

WINDER FOR ROLLING SHEETS OF MATERIAL, ESPECIALLY FOR WINDING PAPER OR CARDBOARD SHEETS INTO REELS

CROSS REFERENCE TO RELATED APPLICATIONS

This application is a national stage of PCT/EP 97/06111 filed Nov. 5, 1997 and based upon German National application 196 49 354.4 of Nov. 28, 1996 under the International Convention.

TECHNICAL FIELD

The invention relates to a winding machine for winding a web of material, particularly a paper or cardboard web into a finished roll.

BACKGROUND OF THE INVENTION

Various types of winding machines are known for the production of wound rolls from paper or cardboard webs longitudinally sectioned into individual webs.

In the so-called winding machines with carrying rollers, two driven carrying rollers form a roller bed in which the winding rolls lie in rows with aligned axes on the carrying rollers, which therefore bear the total weight of the winding rolls (DE 43 34 029-A). The winding hardness which is decisive for roll quality (=surface pressure between the layers of a winding roll) is clearly dependent on the tensile stress exerted during winding of the outermost layer. During winding, this tensile stress is produced by the driven carrying rollers and is decisively influenced by the line load and the geometric conditions in the nip between a winding roll and a carrying roller, since in the nip an additional stretching of the web is generated. The line load is the contact pressure of the winding rolls which is standard for a certain winding roll width, expressed in N/m. Since the stretching in the nip increases with the increasing roll weight, its value limits the maximal final diameter of a finished roll which is free of defects and wound with the desired winding hardness.

In order to be able to keep the line load within a desired low range, in winding machines with support rollers, on both sides of a central support roller, winding stations consisting each of two carrying elements are arranged, to which the individual webs are alternately fed for winding. Each winding station holds a winding roll by means of guide heads rotatably supported on the carrying elements, the heads being laterally introduced into the winding rolls. Thereby the guide heads bear all or part of the weight of the winding rolls. The balance of the winding roll weight—which can tend towards zero—is supported by the support roller. Such winding machines with support rollers make possible the winding of rolls with a large diameter and/or of very sensitive papers with the desired quality (DE 40 12 979-A1).

The support roller in winding machines with support rollers and one of the carrying rollers in the winding machines with carrying rollers serve at the same time as a contact rollers, which together with the winding roll form a roller nip through which the web is fed to the winding roll. A contact roller will have at the same time the function of preventing air from being sucked into the winding rolls, i.e. to seal off the winding rolls over their entire width.

In winding machines with carrying rollers, the tensile stress in the web required for the winding hardness is produced by the carrying rollers acting as a peripheral drive. The carrying rollers than can be connected with a rotary drive. In the winding machines with support rollers, the driven support rollers also act as a peripheral drive. In order to be able to additionally influence the winding hardness, particularly within the range of small winding roll diameters, it is known to provide the guide heads with rotary drives. By means of the rotary drives of the guide heads working as central or core drives it is possible to generate additional torque for influencing the tensile stress at each winding roll.

From the WO 97/28075 a winding machine with carrying rollers is known with two permanently driven carrying rollers. One of the carrying rollers has a shell made of a deformable layer consisting of a cellular plastic material with a plurality of evenly distributed pores and wit a compression modulus κ of less than 10 MPa. The shell layer made of a volume-compressible material reduces the nip-induced stretching of the outermost layer of the winding roll in the roller nip to the carrying roller. In this way the winding of rolls with a larger final diameter is made possible, without damaging the paper or cardboard web and without the occurrence of winding defects in the wound rolls.

From WO 93/15007 it appears that in the case of larger winding rolls (roll widths exceeding 2 m, roll diameter more than 1000 mm), tears and creases can occur in the area of the roll core, if the roll weight borne by the guide head is too large. Therefore in a winding machine with support rollers it is proposed to additionally support the winding rolls below their center of gravity by means of an overpressure generated by compressed air, at a roll diameter of at least 1000 mm.

The WO 95/32908 describes a winding machine with support rollers wherein at the start of the winding process against the winding rolls pressure is exerted from above by rollers, which are swung downwards and from this point on support the winding rolls from underneath. Either roller pairs around which belts are revolving or which have a special soft coating are used.

In all known winding machines, the elements which are not primarily involved in the production of the desired winding hardness, such as elements for holding the winding rolls, for the support of the roll weight, for avoiding winding defects, etc., have at the same time a considerable influence on the winding hardness which is decisive in determining the quality of the wound rolls, or they are constructively very expensive.

OBJECT OF THE INVENTION

It is the object of the invention to provide a winding machine by means of which also heavy winding rolls of sensitive papers can be wound with a high winding quality and speed, without extensive constructive efforts.

SUMMARY OF THE INVENTION

This object is achieved by providing in addition to the usual support or contact roll which engages the winding roll one or more freely rotatable support rolls engage the winding roll from below and extend parallel to the contact roll.

In the winding machine of the invention, one support roller takes over the secondary tasks such as holding of the winding rolls and/or taking up the winding roll weight, without noticeably influencing the winding hardness. If it has a drive, then the latter serves only to accelerate it to a peripheral speed which is synchronous to the winding roll and/or to achieve a hard start of the winding process in the core area. The drive can then be uncoupled, in order to switch the support roller to free running, so that no torque which could influence the winding hardness is generated during winding outwards of the core area.

The contact roller resting against the winding roll can be designed so that it can be limited to its most important functions, namely the guidance of the web on the winding roll and the prevention of air suction into the winding roll. The tensile stress of the web required for the desired winding hardness can be produced during winding by a peripheral drive and/or by means of a center/core drive, whose design does not have to take into consideration the secondary tasks of winding (holding of the rolls, weight takeup). Naturally this does not exclude the fact that, depending on the paper or cardboard type to be wound, the contact roller can assume additional functions; particularly to work as a peripheral drive and/or to take up a part of the winding roll weight.

Winding machines with carrying rollers with a second carrying roller designed according to the invention as a support roller have the further advantage of being capable to wind also sensitive paper types at high production speeds. In the case of sensitive paper types with a high friction coefficient between layers, which do not allow layer displacement between the outer layer and the inner layers of a winding roll, vibrations can occur depending on the winding speed. The vibrations are triggered by the differential speed between the two driven carrying rollers and limit the production speed to very low values.

BRIEF DESCRIPTION OF THE DRAWING

The drawing serves for explaining the invention with the aid of embodiments represented in a simplified manner.

SPECIFIC DESCRIPTION

Figure 1:
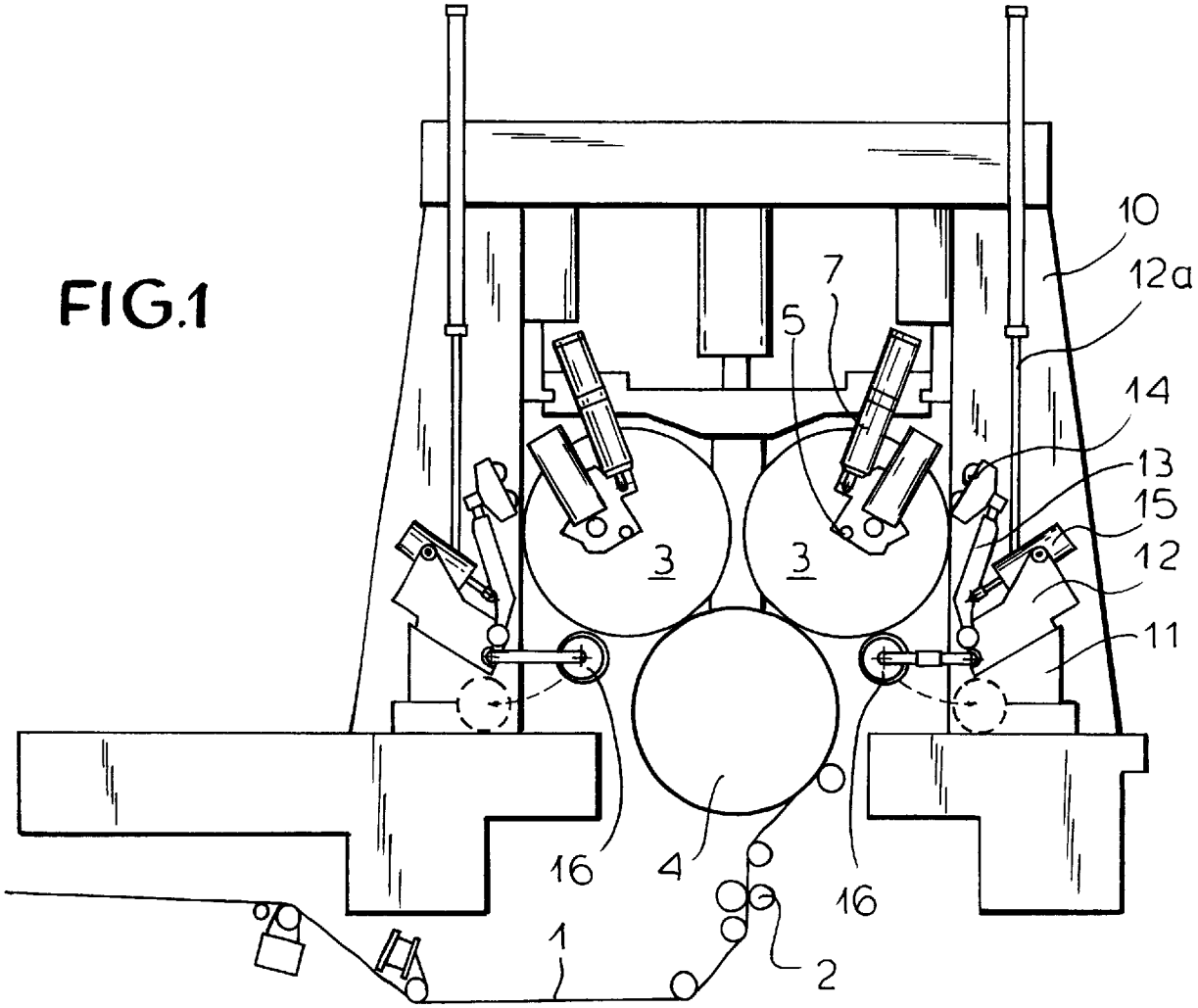
FIG. 1 shows a side view of a winding machine with support rollers according to the invention.

In the winding machine with support rollers represented in FIGS. 1 and 2, the paper or cardboard web 1 with a width of several meters is pulled off a supply roll, subdivided into individual webs by means of a longitudinal cutter 2 and subsequently wound into winding rolls 3. The winding rolls 3 are arranged in two winding lines on both sides of the apex line of a driven support roller 4 made of steel having for instance a diameter of 1500 mm, on which they are supported during winding and which bears the roll weight entirely or partially. Each winding roll 3 is held by rotatably supported guide heads 5 introduced at both sides in its winding core, and which are fastened to the sliding carriage 6. The sliding carriages 6 are each supported on carrying elements 8 and movable approximately radially with respect to the support roller 4 by means of a piston-cylinder unit 7. Each pair of these carrying elements 8, which are movable transversely to the travel direction of the web 1 for adjustment to various web widths, form a winding station at which where one winding roll 3 is being wound.

The support roller serves as a contact roller on which the winding rolls 3 rest under pressure during winding. It forms with each winding roll 3 a roller nip into which each individual web 1 is fed to the pertaining winding roll. At the same time the support roller 4 seals off each winding roll 3, in order to prevent air from being pulled in during winding. A support roller as a contact roller has the additional function to act as a peripheral drive, i.e. rotate turn the winding rolls 3 during winding and to generate the tensile stress required for the winding hardness. In order to additionally influence the winding hardness, particularly in the core area of a winding roll 3, on the sliding carriages 6 additional rotary drives 9 for the guide heads 5 are provided. For various paper types the desired radial course of the winding hardness can be achieved without the additional rotary drives 9, then guide heads which are supported to rotate freely without rotary drives 9 are used.

At a distance from the support roller 4, on each side in the frame 10 of the winding machine a crossbeam 11 is arranged, which by means of a piston-cylinder unit 12*a* can be raised and lowered. For each winding station a sliding carriage 12 is supported on the crossbeam 11 so that it can be moved transversely to the web 1. On each sliding carriage 12 a swivel arm 13 is linked, which at its end bears a pair of pressure rollers 14, which by means of a piston-cylinder unit 15 can be swung towards the periphery of a winding roll 3 in order to enhance the line force at the contact line of the winding rolls 3 on the support roller 4 for the purpose of increased winding hardness, in the initial phase of the winding process when the contact weight is not yet sufficient. The piston-cylinder units 15 are capable to swing the pressure rollers 14 upwards in a neutral rest position, as shown in the figures. In order to remove a finished winding roll 3 from the winding machine, the crossbeam 11 with the thereto fastened pressure rollers 14 can be sufficiently raised.

In order to be able to limit the roll weight borne by the guide heads 5, on each side of the winding machine additional support rollers 16 are arranged next to the support roller 4 and axially parallel thereto, which are supported to move from underneath against a respective winding roll 3. Each additional support roller 16 consists of a carrying element 19 which is a hollow cylinder made of a solid material, particularly of steel, on whose outer shell a layer 20 with limited deformability, made of a cellular plastic material with a plurality of evenly distributed pores, is applied. The plastic material consisting of a cellular elastomer, particularly polyurethane, has a compression module of $\kappa$ of less than 10 MPa, preferably between 1 MPa and 5 MPa. The size of the pores is less than 5 mm, preferably between 0.05 and 1 mm. Preferably the pores in the deformable layer are partially open, i.e. connected to each other and partially closed. The proportion of open pores ranges between 30% and 70%, and preferably amounts to 50%. The ratio of open pores to the closed pores determines the compressibility as well as the capability of the layer to disperse the heat generated inside, in order to avoid undesirable overheating. The above-mentioned parameters have proven to be particularly suited.

The diameter of the additional support rollers 16 equals 300 mm to 600 mm, preferably approximately 400 mm, the radially measured thickness of the deformable layer 20 ranges between 10 mm to 40 mm, preferably 15 mm to 25 mm. Advantageously to each pressure roller sliding carriage 12 one additional support roller 16 is assigned and has an axial length corresponding to the length of the pressure rollers 14, approximately 400 mm in the example. Each additional support roller 16 is supported on the pertaining pressure roller sliding carriage 12 so that it can be swung upwards and pressed with a controlled force against the underside of a winding roll 3 by means of a pneumatic piston-cylinder unit not shown in the drawing. The way it is supported on the pressure roller sliding carriage 12 has the advantage that the additional support rollers 16 are therewith automatically set in a transverse position. As a rule several axially aligned additional support rollers 16, arranged next to each other, support a winding roll 3 over its entire axial length which can reach up to 3.5 m.

In order to achieve a friction free contact at the winding rolls during winding, each additional support roller 16 is connected to a rotary drive which can be turned on and off, by means of which its peripheral speed can be synchronized prior to its contact with a winding roll 3 with the peripheral speed of the latter. Subsequently the automatic synchronizer is turned off and the additional support roller 16 lies freely rotatable against the respective winding roll 3.

Figure 2:
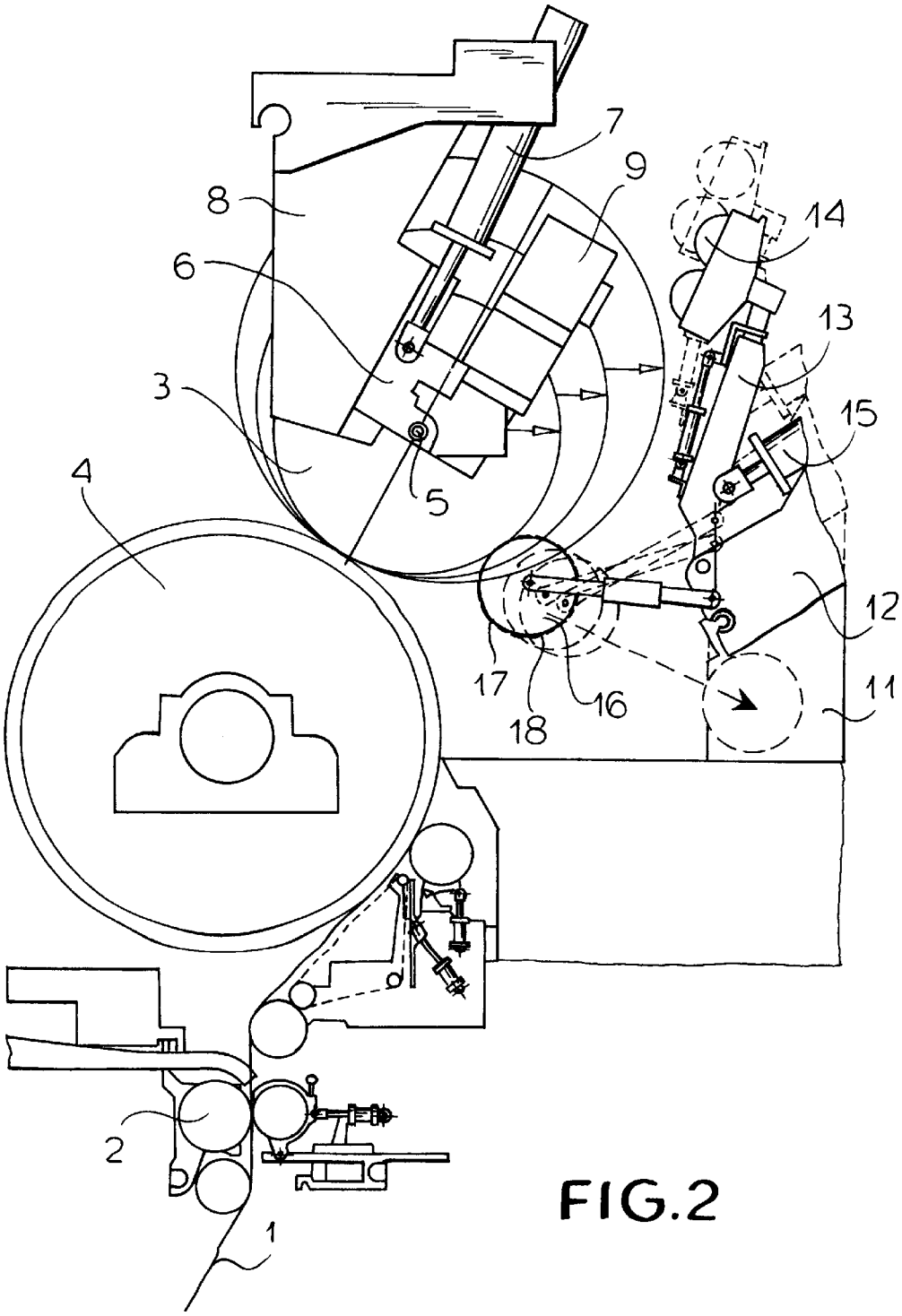
FIG. 2 shows an enlarged detail of FIG. 1.

Since for the removal of a full winding roll 3 the pressure roller crossbeam 11 with the elements fastened thereto has to be raised, each additional support roller 16 can be receivable in a corresponding recess of the crossbeam 11 (see the broken line position in FIG. 2). All additional support rollers 16 of one winding line are therefore moved upwards with the crossbeam 11 into a position wherein below the crossbeam 11 there is a sufficient free space through which a fully wound winding roll 3 can be removed from the winding machine.

At the start of the winding process the crossbeams 11 are lowered into their lower position and the pressure rollers 14 are moved towards the winding rolls 3, in order to increase the line force at the contact point with the support roller 4. When the supported weight of the winding rolls 3 has reached a certain value, at first the further weight increase is compensated in such a way that by means of the retracting piston-cylinder unit 7 a relieving force is applied to the guide heads 5. Starting from a maximal roll diameter of approximately 1000 mm at the latest, a further relief takes place due to the additional support rollers 16, so that the roll weight borne by the guide heads 5 does not increase too much. For this purpose the additional support rollers 16 are removed from their rest position in the crossbeam 11, accelerated to a peripheral speed synchronized with the peripheral speed of the winding rolls 3 and subsequently pressed from underneath against the winding rolls 3. With the increasing diameter of the winding rolls 3 the additional support rollers 16 are correspondingly guided—as shown in FIG. 2—, preferably by a combined swing and vertical motion. The latter motion can be achieved through a linear vertical movement of the pressure roller cross beam 11.

The relieving force of the additional support rollers 16 is controlled by the upwards pushing pneumatic piston-cylinder units so that the desired distribution of the winding roll weight on the support roller 4, the additional support rollers 16 and the guide heads 5 is achieved. The weight distribution is controlled depending on the diameter, in order to achieve the desired winding buildup.

After the winding process is concluded, at first the additional support rollers 16 are immersed into the crossbeams 11. Subsequently the crossbeam 11 with the additional support rollers 16 and the pressure rollers 14 is moved upwards into an upper parking position, in which the winding rolls 3 can be removed from the machine.

Figure 3:
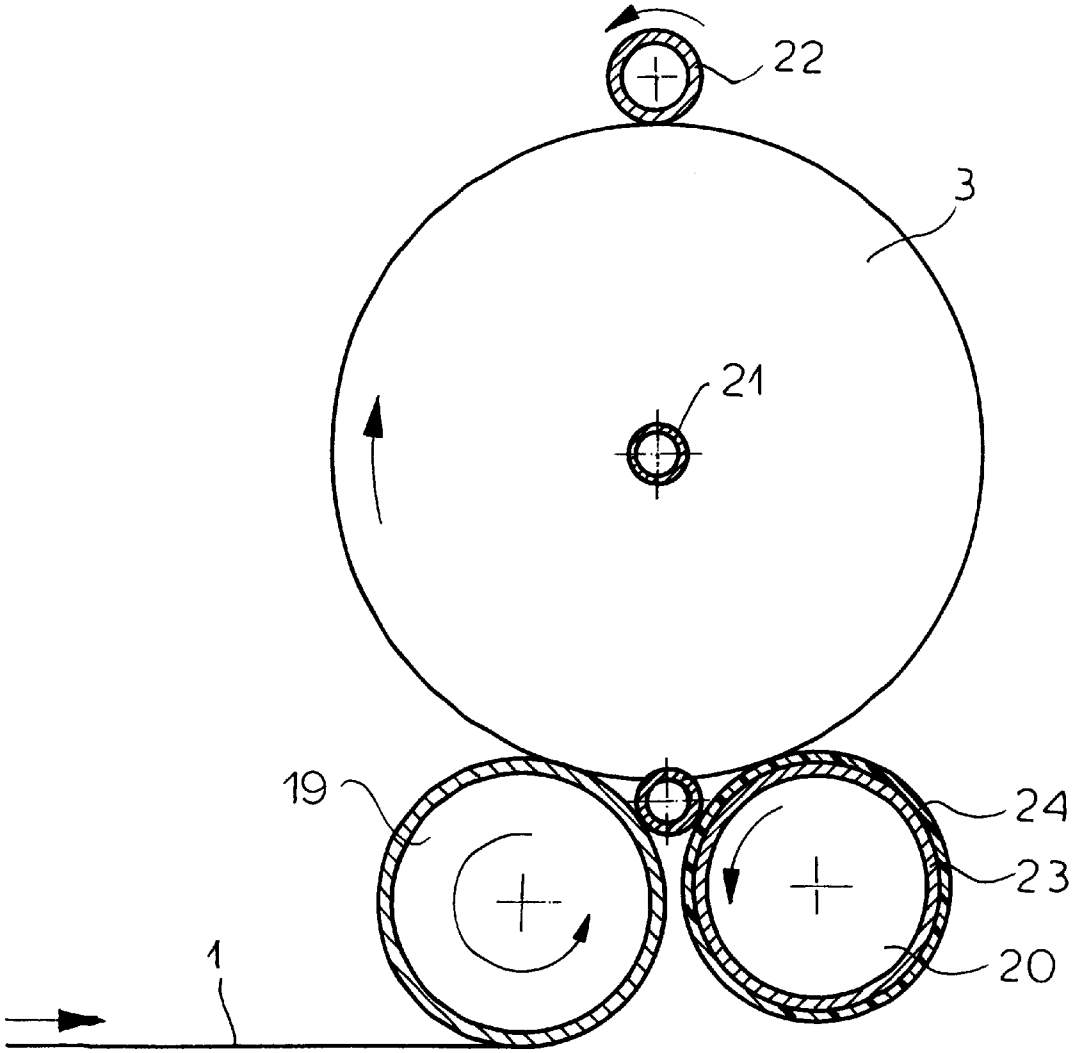
FIG. 3 shows schematically a side view of a winding machine with carrying rollers wherein the web is fed from underneath through the gap between the carrying rollers.
Figure 4:
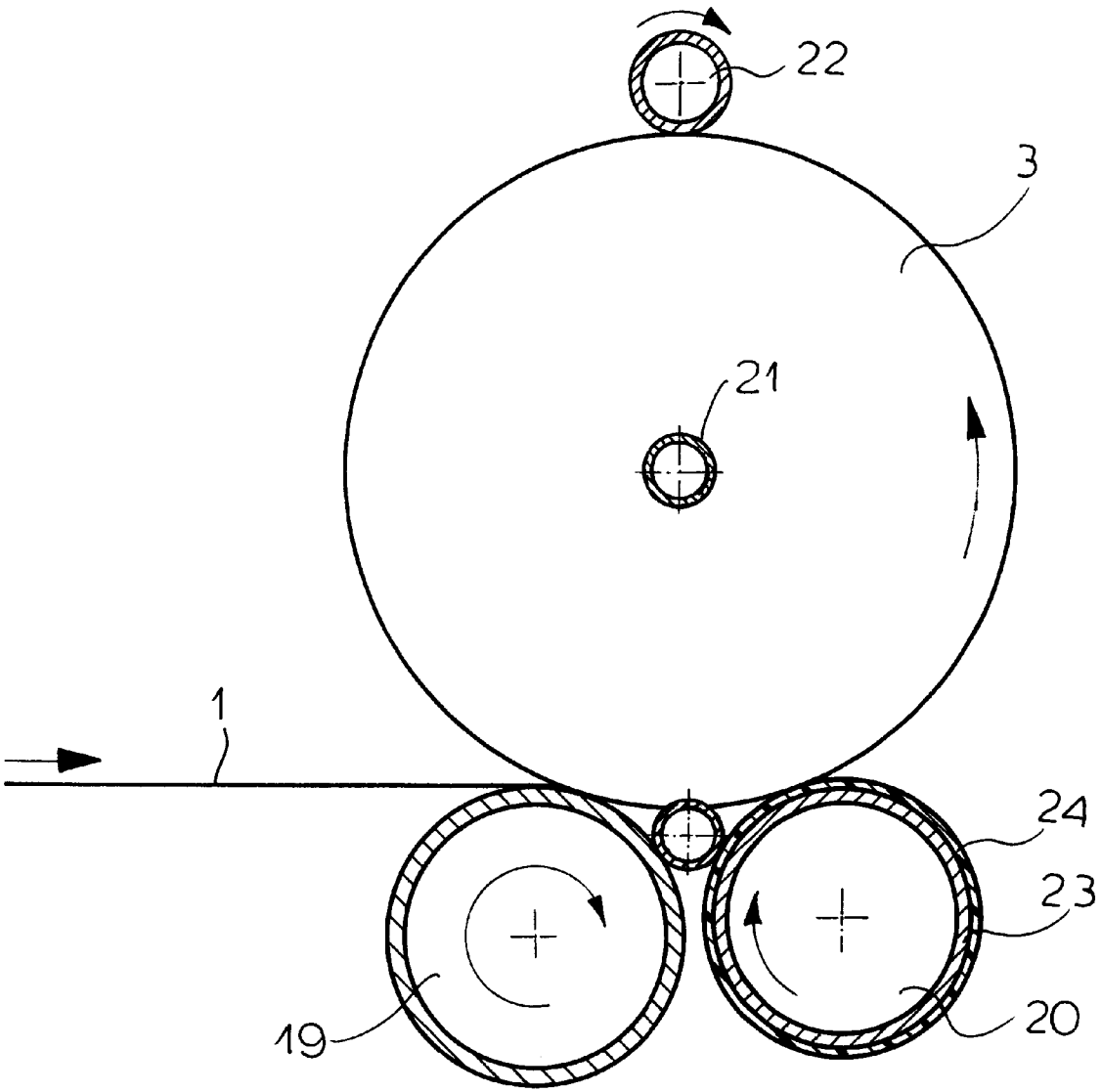
FIG. 4 shows a winding machine with carrying rollers with an alternative feeding of the web.

FIGS. 3 and 4 show a winding machine with carrying rollers. which has a driven carrying roller 19 as a contact roller. In addition to this first carrying roller 19, an axially parallel support roller 20 is arranged, which together with the first carrying roller 19 forms a roller bed, wherein the winding rolls 3 are lying on the rollers 19, 20 during winding. Just like the first carrying roller 19, the second carrying roller 20 extends over the entire work width, i.e. the maximal width of the paper or cardboard web 1 to be wound. The paper or cardboard web 1 is divided into individual webs by a longitudinal cutter, which in the embodiment of FIG. 3 are guided into the roller bed through the gap between the carrying rollers 19, 20, where they are wound onto rows of aligned winding cores 21. Above the roller bed in the frame of the winding machine a pressure roller system is arranged, which comprises a pressure roller 22 supported to run freely. At the start of the winding precess, when the weight of the winding rolls 3 borne by the carrying rollers 19, 20 is not sufficient for obtaining the desired winding hardness, it is possible to increase the weight of winding roller 3 borne by the carrying rollers 19, 20 by means of the pressure rollers 22 pressing from above. On each side of the machine a guide head is supported vertically movable, each being introduced from the outside into the core 21 of the marginal roll, in order to laterally guide the set of winding rolls 3 during winding.

The two carrying rollers 19, 20 have a diameter of 300 mm to 1000 mm. Their axial length depending on the width of the paper or cardboard web 1 can amount up to 10 m. The incoming side of the carrying roller 19 has a steel shell, which can be coated with an elastically deformable running layer made of a solid elastomer, such as rubber. It has the primary task to guide each individual web 1 into the roller nip formed with the respective winding roll 3 and to prevent the introduction of air into the winding rolls 3. Additionally in the roller nip between the carrying roller 19 and the winding roll 3 the desired winding hardness is produced through nip-induced stretching. In order to fulfill this function, the coating of the carrying layer 19 is not volume-compressible.

The second carrying roller 20 serving as a support roller consists of a carrying body 23 shaped as a hollow cylinder of solid material, particularly steel, on whose outer shell a volume-compressible layer 24 of a cellular plastic material with a plurality of evenly distributed pores is applied. The thickness and the material characteristics of the layer 24 correspond to the ones of the layer 20 of the additional support rollers 16 of the aforedescribed winding machine with support rollers according to FIGS. 1 and 2. The second carrying roller 20 is supported freely rotatable or connected with a rotary drive which can be switched to free run. In case that there is a rotary drive, it serves only for the acceleration of the carrying roller 20 when the winding is started, in order to synchronize its speed with the carrying roller 19, and/or to cause a hard winding start in the core area of the winding rolls 3. During winding outside of the core area of a winding roll 3 the rotary drive is uncoupled. The carrying roller 20 rotates freely, so that no torque influencing the winding hardness is generated. During winding outside of the core area of a winding roll, the carrying roller 20 serves exclusively for holding the winding rolls 3 in their winding position and for bearing a part of the winding roll weight, without the influence of torque or the generation of a nip-induced stretching on the winding hardness. In relation to the carrying roller 19 on the incoming side serving as a contact roller, the carrying roller 20 serving as a support roller is arranged so that it bears between 30% and 80% of the winding roll weight. The rest of the winding roll weight is borne by the carrying roller 19.

The pressure roller 22 of the pressure roller system has preferably also a volume-compressible running layer with the characteristics of the layer 24. It is designed as a continuous freely rotatable roller or it consists of separate roller segments supported to rotate freely.

FIG. 4 shows a winding machine with carrying rollers wherein the web 1 is guided into nips between the carrying roller 19 and the winding rolls 3 from the top, being only slightly wrapped around the carrying roller 19 on the incoming side. The modified web feeding leads to the fact that the rotation direction of the carrying rollers 19, 20, of the winding rolls 3 and of the pressure roller 22 is opposite to the rotation direction in the winding machine with carrying rollers shown in FIG. 3. Otherwise the construction of this winding machine with carrying rollers corresponds to the construction of the winding machine with carrying rollers according to FIG. 3.

Figure 5:
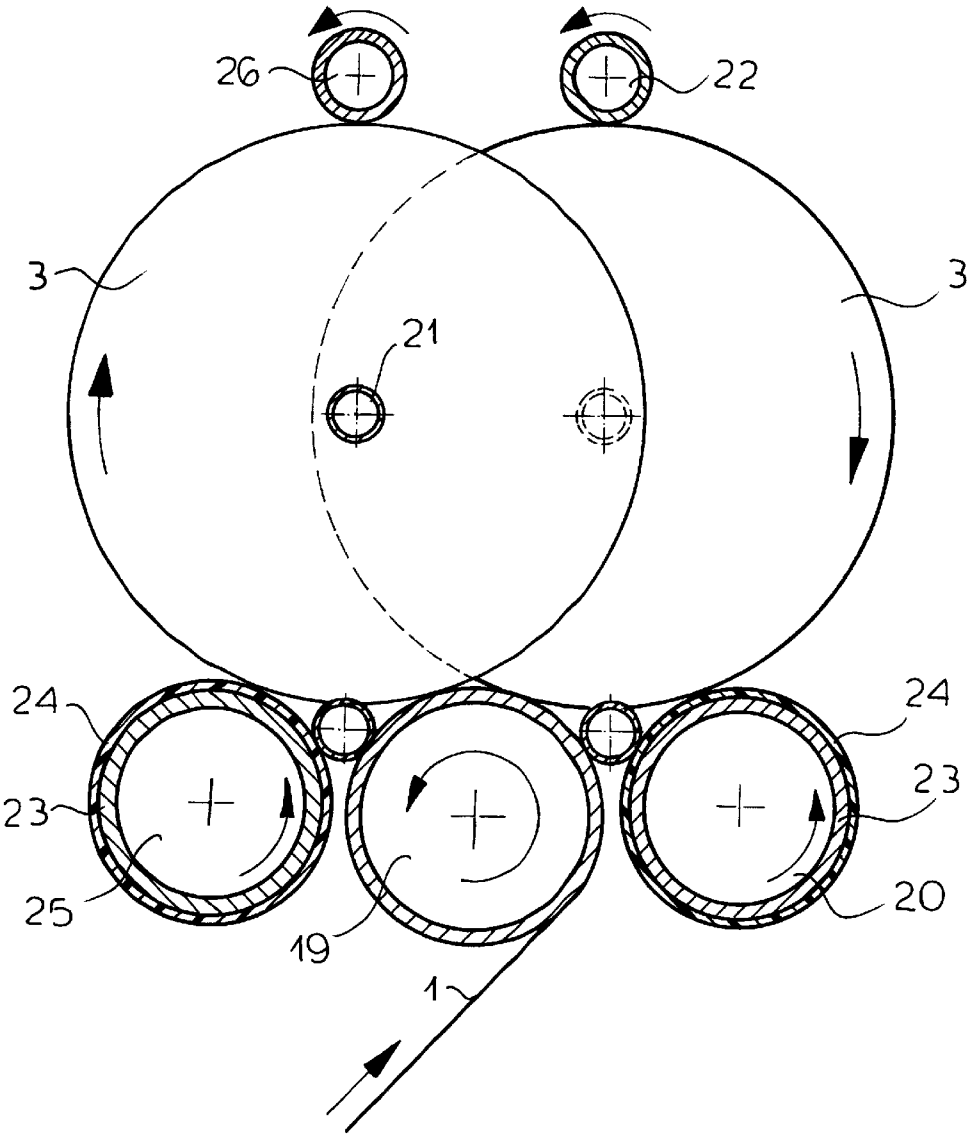
FIG. 5 shows a winding machine with carrying roller having a third carrying roller serving as a support roller.

In FIG. 5 a further embodiment of a winding machine with carrying rollers is described, wherein a second support roller 25 is arranged as a third carrying roller next to the first carrying roller 19 serving as contact roller, on the side opposite to the second carrying roller 20. The construction of the third carrying roller 25 corresponds to the construction of the second carrying roller 20. It also comprises a running layer 24 of a volume-compressible plastic material. It is also freely rotatable connected with a rotary drive which can be uncoupled, so that it can be switched to free running. The third carrying roller 25 forms with the first carrying roller 19 a second roller bed, wherein every second winding roll is wound up. In order to be able to enhance the contact weight of the winding rolls 3 of each winding line, the pressure roller system comprises two freely rotatable pressure rollers 22, 26, each of them being applicable to the apex lines of the winding rolls of one winding line. Thereby the second pressure roller 26 corresponds in construction and function to the first pressure roller 22, which is described in the embodiment example of FIG. 3.

What is claimed is:

1. A winding machine for winding a material web into winding rolls comprising:

at least one contact roller supporting said winding rolls from below;

means for rotating the winding rolls for producing a tensile stress in the web during winding, said contact roller lying against the winding rolls under pressure, the web being fed to the winding rolls; and at least one additional support roller is arranged underneath the winding rolls for taking up at least a part of a winding roll weight said support roller extending axially parallel to the contact roller, being supported to be freely rotatable or being switchable to be free running, and having on an outer shell periphery a deformable layer of a cellular plastic material with a plurality of evenly distributed pores and a compression modulus κ of less than 10 MPa.

2. The winding machine according to claim 1 wherein said layer consists of a polyurethane cellular elastomer with a compression modulus κ ranging between 1 MPa and 5 MPa.

3. The winding machine according to claim 1 wherein said pores are of a pore size between 0.05 mm and 1 mm.

4. The winding machine according to claim 1 wherein the pores in the layer are partially open and partially closed with a proportion of the open pores ranging between 30% and 70%.

5. The winding machine according to claim 1 wherein said layer is of a thickness ranging between 10 mm to 40 mm.

6. The winding machine according to claim 1, further comprising:

a longitudinal cutter for sectioning the web into individual webs, which are wound into separate winding rolls on respective winding cores.

7. The winding machine according to claim 6, wherein the contact roller is a driven roller against which the winding rolls rest during winding, whereby in two winding lines on both sides of the driven roller winding stations are arranged, each consisting of two carrying elements movable transversely to a web travel direction and to which a guide head insertable in the respective winding core is fastened.

8. The winding machine according to claim 7 wherein one guide head of each winding roll is connected with a rotary drive.

9. The winding machine according to claim 6 wherein the contact roller is a driven carrying roller, and the support roller is arranged as a second carrying roller axially parallel next to the first carrying roller and extending over the length of the same, in order to form a roller bed with the first carrying roller in which the winding rolls lie during winding.

10. The winding machine according to claim 9 wherein a second support roller is arranged as a third carrying roller on an opposite side of the first carrying roller from the second carrying roller and forms a second roller bed with the first carrying roller, whereby two neighboring individual webs are fed respectively to alternate roller beds.

11. The winding machine according to claim 9 wherein individual webs are guided into the roller bed from below, through a gap between the contact roller and the support roller.

12. The winding machine according to claim 9 wherein the support roller is arranged as a carrying roller in relation to the contact roller so that the rollers take up between 30% and 80% of the winding roll weight.

13. A winding machine for winding a material web into winding rolls comprising:

at least one contact roller supporting said winding rolls from below;

means for rotating the winding rolls for producing a tensile stress in the web during winding, said contact roller lying against the winding rolls under pressure, the web being fed to the winding rolls; and at least one additional support roller is arranged underneath the winding rolls for taking up at least a part of a winding roll weight said support roller extending axially parallel to the contact roller, being supported to be freely rotatable or being switchable to be free running, and having on an outer shell periphery a deformable layer of a cellular plastic material with a plurality of evenly distributed pores and a compression modulus κ of less than 10 Mpa; and a longitudinal cutter for sectioning the web into individual webs, which are wound into separate winding rolls on respective winding cores, said contact roller being a driven roller against which the winding rolls rest during winding, whereby in two winding lines on both sides of the driven roller winding stations are arranged, each consisting of two carrying elements movable transversely to a web travel direction and to which a guide head insertable in the respective winding core is fastened.

14. The winding machine according to claim 13 wherein pressure rollers are supported on said cross beam swinging against the winding rolls.

15. The winding machine according to claim 14 wherein each support roller is supported on a sliding carriage carrying the pressure rollers.

16. The winding machine according to claim 13 wherein the support rollers can be moved into a rest position inside the crossbeam (11).

* * * * *